US005913638A

United States Patent [19]

Lansdale

[11] Patent Number: 5,913,638

[45] Date of Patent: Jun. 22, 1999

[54] SAND CHANNEL TRENCHING AND PIPE LAYING APPARATUS

[76] Inventor: Michael Lee Lansdale, 1022-A San Andreas Rd., La Selva Beach, Calif. 95076

[21] Appl. No.: 09/018,710

[22] Filed: Feb. 4, 1998

[51] Int. Cl.[6] ..... F16L 1/028

[52] U.S. Cl. ..... 405/179; 405/180; 37/367

[58] Field of Search ..... 37/142.5, 367, 37/364, 465; 405/174–183, 267

[56] References Cited

U.S. PATENT DOCUMENTS 2,788,725 4/1957 Wilkey et al. ..... 37/367 X
4,812,078 3/1989 Rivard ..... 405/179

FOREIGN PATENT DOCUMENTS 55-122929 9/1980 Japan .

*Primary Examiner*—David J. Bagnell
*Assistant Examiner*—Sunil Singh
*Attorney, Agent, or Firm*—Jeffrey A. Hall

[57] ABSTRACT

A sand channel trenching and pipe laying apparatus for attachment to a tractor or other motor driven vehicle has an elongated frame with a turf precutter assembly which includes both a pair of vertical cutting blades and horizontal blades for removing a strip of turf. Channel excavation apparatus for digging a pipe channel is operably mounted to the frame. A pipe dispenser for laying and positioning pipe in the pipe channel is secured to a subframe mounted on a rearward portion of the frame. A sand funnel for funneling and directing sand into the pipe channel is operably linked to a sand hopper and is mounted on the same subframe as the pipe layer. A ball valve and hose attachment device provide a controlled flow of water in the sand hopper allowing for liquification of the sand in the sand hopper forcing the sand to flow through the sand funnel into the pipe channel.

10 Claims, 3 Drawing Sheets

SAND CHANNEL TRENCHING AND PIPE LAYING APPARATUS

BACKGROUND OF THE INVENTION

1. Field of Invention

This invention relates to excavating and trenching apparatuses, and more particularly to apparatuses providing turf-strip excavating devices with excavation, pipe feeders, and sand or gravel funnel means for digging and laying pipe and depositing sand or gravel in sand channels for golf courses, sportsfields, parks and the like.

2. Description of the Related Art

Various mechanized excavating apparatuses have been proposed and implemented for digging, trenching, and laying cables, flexible pipe, ducts, or other elongated objects in the ground. Mechanized units are known for carrying out these different operations and typically include a motor driven vehicle, usually a tractor or public works type vehicle, on which are mounted a holder for such elongated objects, and a digging wheel for digging the trench. Typically, a guide device for laying the elongate objects in the bottom of the trench is connected to the vehicle and causes the objects to assume a curvature so that they are positioned correctly when laid in the trench.

Accordingly, during movement of the motor driven vehicle, the digging wheel, driven by a motor, digs a trench while discharging the earth on either side thereof and, simultaneously with its formation the elongated objects pass through the guide device and are laid in the bottom of the trench. Such devices, however, are limited in their usefulness in many situations, such as sportsfields, golf course, parks and the like.

Other limitations of prior devices include lack of turf pre-cutting means, inefficient pipe feeder means, and cumbersome and ineffective sand or gravel deployment means, which are all critical for the proper laying of pipe or other drainage means in sportsfields, golf courses, parks and the like.

Accordingly, it is the primary object of this invention to provide a channel trenching and pipe laying apparatus for laying pipe and covering the pipe with sand or gravel in sportsfields, golf courses, parks, and the like which overcomes the aforementioned difficulties and is highly efficient in precutting strips of turf, trenching or channeling, laying pipe, and then filling the trench or channel with sand or gravel. The present invention also allows for the preparation of a narrow, intermediate, or broad channel and a miniaturization of apparatus size so it may be used on golf greens, for example.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

The sand channel trenching and pipe laying apparatus of the present invention is useful for laying pipe, trenching, and sand or gravel laying in sportsfields, golf courses, parks, and the like. The present invention principal components include turf precutter means, channel excavating wheels, a pipe feeding and dispensing device, a sand or gravel hopper and funnel, and water plumbing means for creating a wet sand or gravel flow.

To achieve the foregoing objects, and in accordance with the purpose of the invention as embodied and broadly described herein, a sand channel trenching and pipe laying apparatus for attachment to a tractor or other motor driven vehicle includes an elongated frame with a turf precutter assembly having a pair of cutting blades. Channel excavation apparatus for digging a channel is operably mounted to the frame. A pipe dispenser for laying and positioning pipe in the channel is secured to a subframe mounted on a rearward portion of the frame. A sand or gravel funnel for funneling and directing sand or gravel into the channel is operably linked to a sand or gravel hopper, and is mounted on the same subframe as the pipe layer. A ball valve and hose attachment device provide a controlled flow of water in the sand or gravel hopper allowing for liquification of the sand or gravel in the sand or gravel hopper forcing the sand or gravel to flow through funnel into the channel.

There is also provided, according to the invention, a trenching and pipe laying apparatus for mounting to a tractor, comprising an elongated frame including a pair of spaced apart sides and hitch means for connecting the trenching and pipe laying apparatus to the motor driven vehicle. Turf precutting means for cutting a strip of turf are mounted to the elongated frame. Channel excavation means for digging a channel are mounted to the frame, with pipe dispensing means for dispensing and laying pipe in the channel mounted to a subframe secured to the elongated frame. A hopper is mounted to the elongated frame with a funnel for funneling and directing sand or gravel into the channel. Sand or gravel liquifying means for liquifying sand or gravel within the sand or gravel hopper are provided, however, the sand or gravel may, if desired be applied dry.

The sand channel trenching and pipe laying apparatus device of the present invention may be provided in a variety sizes for various applications. The apparatus may be provided so it can dig and lay down pipe and backfill with sand or gravel in one, two, or multiple channels. The hopper and funnel are configured for use with either wet or dry sand or gravel, depending upon the application.

The present invention is configured to permit rapid and efficient turf precutting, channel excavation, pipe laying, and sand or gravel backfilling in sportsfields, golf courses, parks, and related areas. It may be attached and pulled by a tractor or other motor vehicle and is very easy to operate and service.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided in a preferred embodiment of the invention, a sand channel trenching and pipe laying apparatus for attachment to a tractor or other motor driven vehicle which has an elongated frame with a turf precutter assembly which includes a pair of vertical cutting blades and a horizontal turf strip remover blade. Channel excavation apparatus for digging a channel is operably mounted to the frame. A pipe dispenser for laying and positioning pipe in the channel is secured to a subframe mounted on a rearward portion of the frame. A funnel for funneling and directing sand or gravel into the channel is operably linked to a hopper and is mounted on the same subframe as the pipe layer. A ball valve and hose attachment device provide a controlled flow of water in the hopper allowing for liquification of the sand or gravel in the sand forcing the sand or gravel to flow through the funnel into the channel.

In accordance with the present invention, there is also provided, a trenching and pipe laying apparatus for mounting to a tractor, comprising an elongated frame including a pair of spaced apart sides and hitch means for connecting the trenching and pipe laying apparatus to the motor driven vehicle. Turf precutting means for precutting strips of turf are hingedly mounted to the elongated frame. Channel excavation means for digging a channel are mounted to the frame, with pipe dispensing means for dispensing and laying pipe in the channel mounted to a subframe secured to the elongated frame. A hopper is mounted to the elongated frame with a funnel for funneling and directing sand or gravel into the channel is attached thereto, and secured to the same subframe as the pipe layer. Sand or gravel liquifying means for liquifying sand or gravel within the hopper are provided, however, the sand or gravel may, if desired be applied dry.

Figure 1:
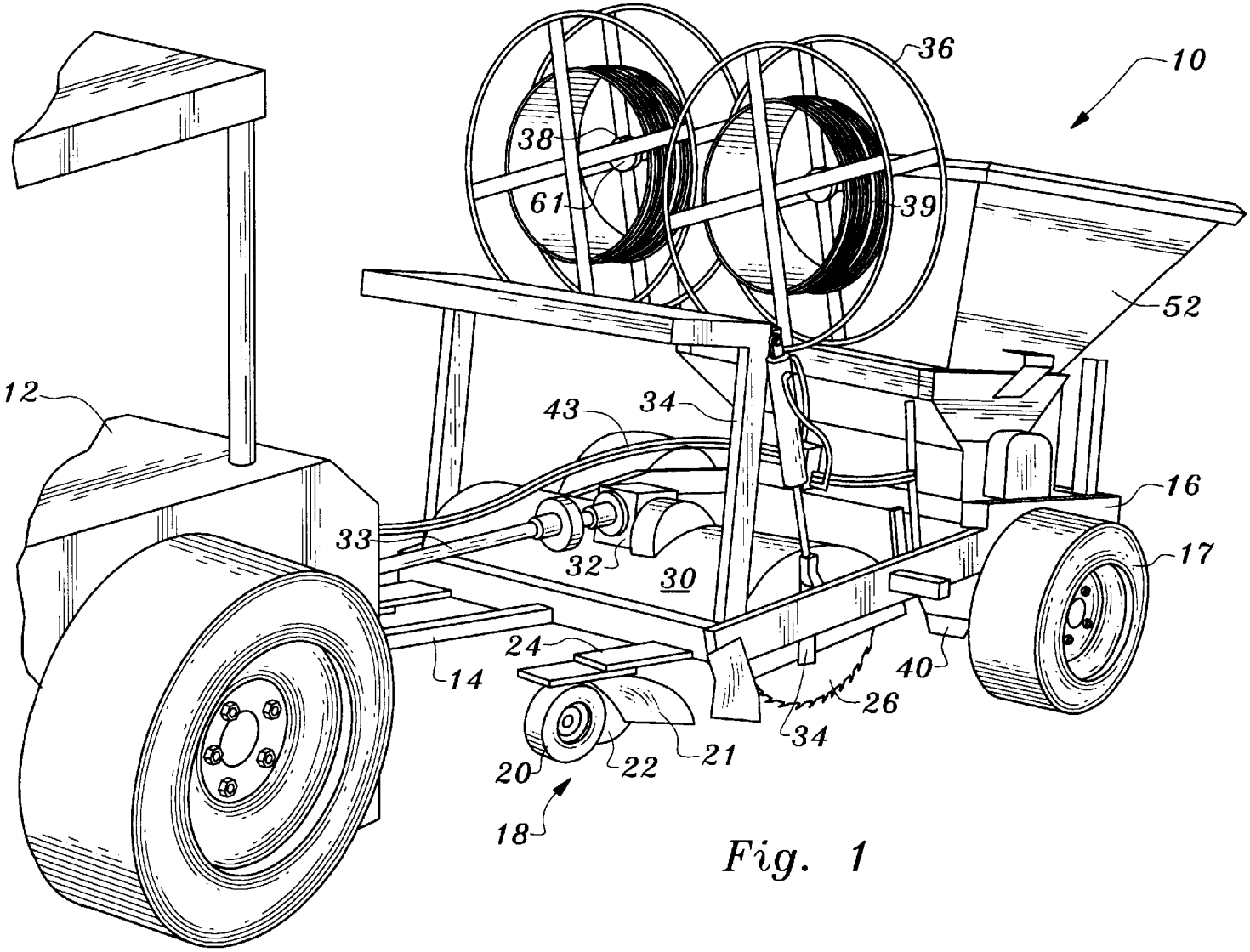
FIG. 1 is a front perspective view of a sand channel trenching and pipe laying apparatus, according to the invention.
Figure 2:
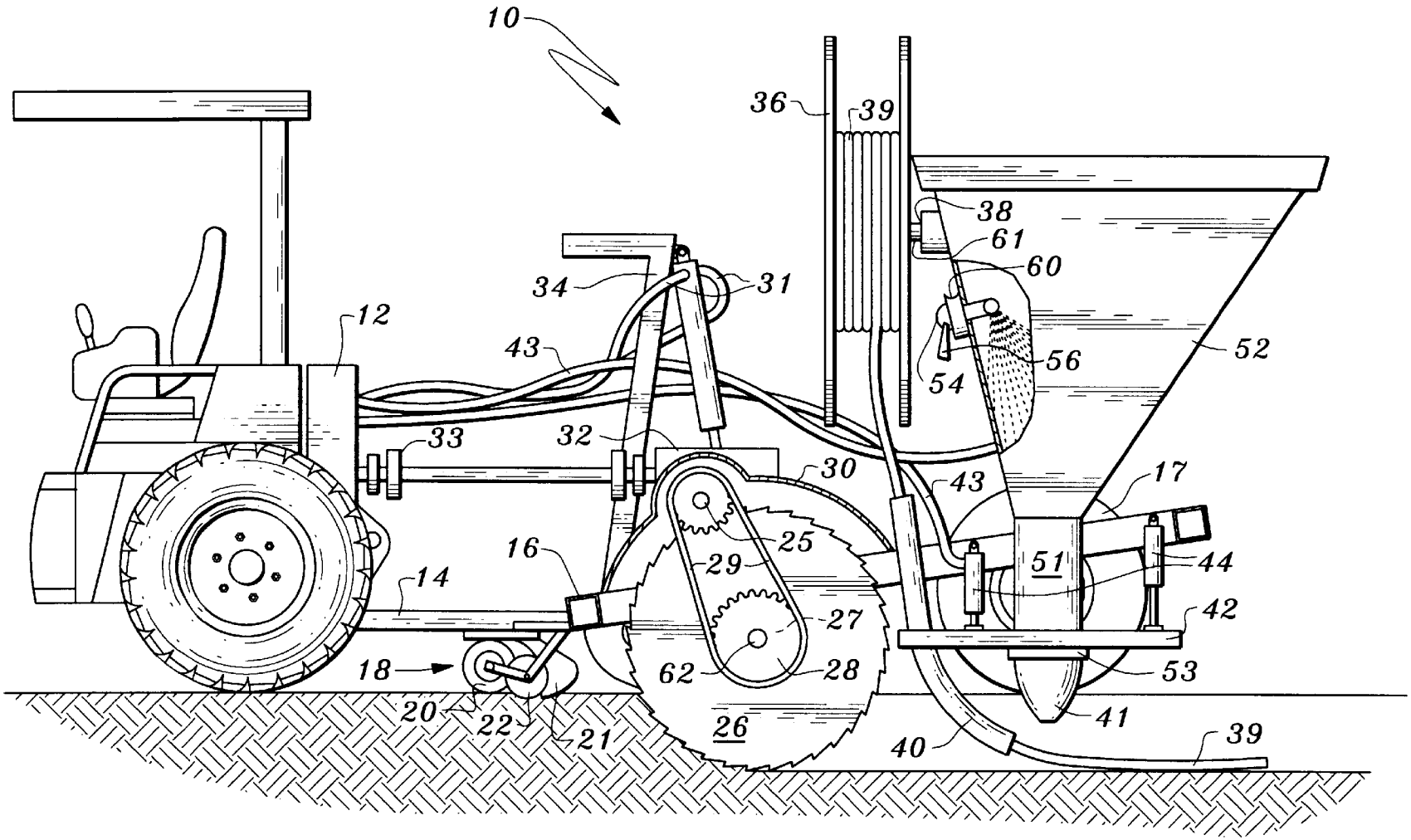
FIG. 2 is a side view of such apparatus, according to the invention.

In FIGS. 1 and 2, trenching and pipe laying apparatus 10 is shown according to a preferred embodiment of the invention, attached to a motor driven vehicle, such as tractor 12 by hitch 14. Trenching and pipe laying apparatus 10 has a main frame 16 with wheels 17 secured thereto. A turf precutter assembly 18 is shown secured to frame 16 including depth adjustment wheel 20, a pair of vertical cutting blades 22 for side cutting, and horizontal strip remover blade 21 secured via subframe 24. Subframe 24 is hingedly attached to main frame 16.

Channel excavation means for digging a channel in turf preferably comprise cutting wheel 26 with chain linkage 29 or alternatively a chain with cupped teeth on a chain guide for digging into the dirt, either of which are protected by protective cover 30. Cutting wheel 26, chain sprocket 28, and chain 29 are operably linked to hub 27 and to gear box 32 and to tractor PTO 33, with cutting wheel 26 being operably mounted to subframe 34. Means for lifting or lowering the channel excavation means is preferably provided by a hydraulic ram connected to hydraulic ram line 31.

Figure 3:
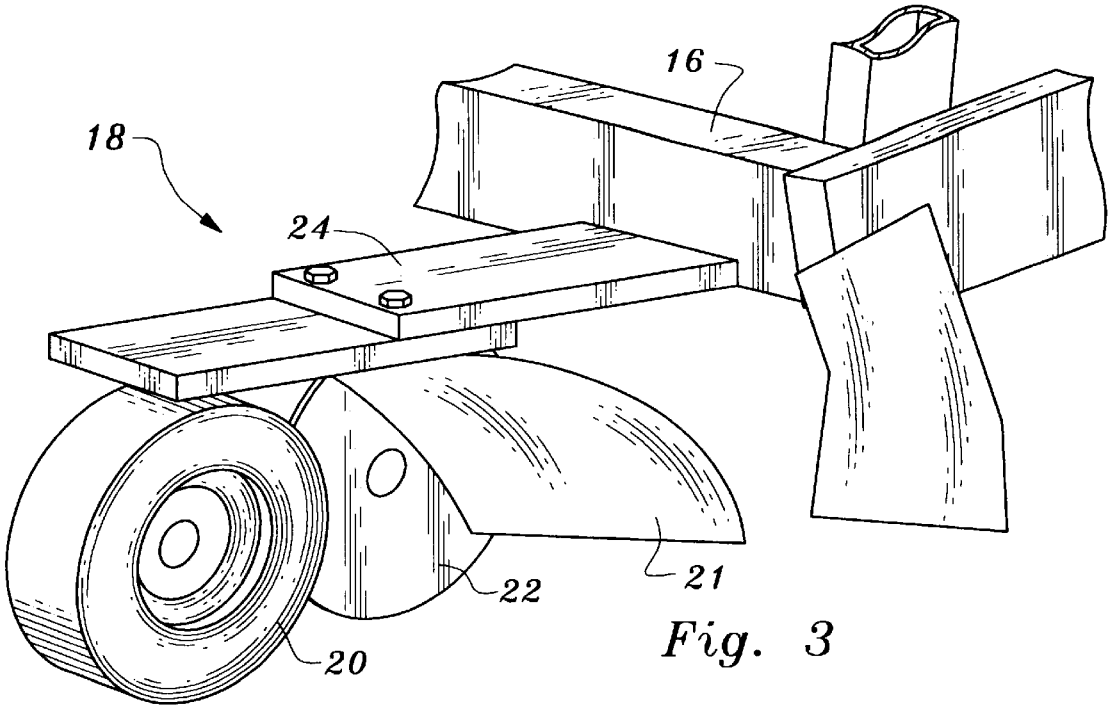
FIG. 3, is a perspective view of the turf-precutter assembly, according to the invention.

As seen in FIGS. 1 and 3 turf precutting assembly 18 is secured to frame 16 of trenching and pipe laying apparatus 10. Although apparatus 10 is shown with one turf precutter assembly 18 in FIGS. 1 and 3, in alternative embodiments two or more precutter assemblies may be used for the installation of two or more channels simultaneously. Preferably each turf precutter is made of a pair of wheels 20 and pair of vertical cutting blades 22 for cutting the turf and horizontal turf strip remover blade preferably made of steel or other hard metal. Cutter 21 excavates a strip of turf preferably by raising it to the surface and depositing to the side of the cut. It thus raises and moves turf over while the forward movement of the tractor forces the strip of turf to come up and be displaced.

The turf precutter assembly or assemblies are hingedly secured to frame 16 with subframe 24 and are preferably raised and chained to frame 16 when not in use. Sideways adjustments may be made if desired and weights may be used to force the precutter assembly to cut deeper in the turf if desired.

Best seen in FIG. 1 the channel excavator means comprise a cutting wheel 26 with evenly spaced cutting teeth. Preferably there are "scalops" or gouges taken out of the wheel between the cutting teeth, about two inches deep and rounded to create room for the excavated soil before it is moved to the surface of the ground. Cutting wheel 26 may be cut in half so that it can be easily mounted on shaft 62. The teeth of wheel 26 are preferably either square headed chipper type teeth or shark shaped teeth. Cutting wheel 26 is mounted to hub 27 which is secured to shaft 62. Preferably, shaft 62 is bearing attached to subframe 34 that is hingedly secured to the inside front portion of frame 16 allowing subframe 34, shaft 62, and cutting wheel 26 to pivot up out of the ground, or to dig to an approximate minimum depth of nine inches in the ground. This is via hydraulic ram and line 31, operably controlled by control means on tractor 12.

In another embodiment, a chain digger type device is used for channel excavation. While the subframe, shaft, and end sprocket are the same as the previously described embodiment, the shaft 62 a drives a chain with digging cups attached to it for bringing dirt and rocks to the surface and is secured around a fixed chain guide which may be raised or lowered using hydraulic ram and line 31. Preferably both the embodiments described are driven by a shaft from the PTO of the tractor which is connected to a right angle transfer box which has a chain connecting its sideways sprocket to a sprocket 25 on the cutters shaft 62. Preferably, both the cutting wheel and chain digger remove soil leaving approximately a one inch wide and nine inch deep sand channel opening.

Pipe dispensing means for laying and positioning pipe 39 are preferably provided by pipe reel 36 with bearings 38 secured to hopper 52 by support 61 and pipe layer 40 secured to subframe 42. As with all assemblies described herein, one, two, or multiple pipe dispensing means may be mounted to sand channel trenching and pipe laying apparatus 10. For example, if laying two lines of pipe simultaneously are a preferred application, apparatus 10 may be provided with two duplicate pipe dispensing means as described. If one line of pipe is a preferred application, then one pipe dispensing means would be used is the embodiment. Pipe layer 40 is preferably about 1.5 inches in diameter and about 16 inches long in the preferred embodiment, but may be sized to accommodate any size or diameter of pipe, and is preferably bent at an 80 degree turn so as to lay pipe 39 at the bottom of the sand channel. Pipe layer 40 is secured to subframe 42 and is operably lined to hydraulic ram 44 linked to hydraulic line 43 and to a control lever which may be positioned at the rear end of apparatus 10. Pipe layer 40 may be attached to subframe 42 by bolts, screws, or other mechanical fastening means well known in the art. As tractor 12 pulls forward, pipe 39 is pulled through pipe layer 40 and positioned at the bottom of the channel being dug.

Funnel 41 for funneling and directing sand or gravel into the channel is operably secured to subframe 42 and to connector 51 which is preferably composed of rubber. Sand funnel 41 is preferably about 12 inches wide by 12 inches long at its top end and drops for about 4 inches then funnels down to about ¾ inches wide by about 6 inches long, and then drops straight down for 4 inches. Of course, other configurations may be used, such as a conventional funnel shape in alternative embodiments. A horizontal plate 53 is at the top of the funnel if desired, and has a substantially round opening with a lip to which is attached connector 51. Connector 51 is secured to sand hopper 52 by either a screw clamp or other fastening means well known in the art. As subframe 42 is lowered by hydraulic ram 44, connector 51 lengthens and the sand or gravel flows from hopper 52 to funnel 41 and into the channel. When subframe 42 is raised connector 51 is crimped and the sand stops flowing. The desired height of the sand or gravel placement is determined by the height of the bottom rear opening of the funnel.

Figure 4:
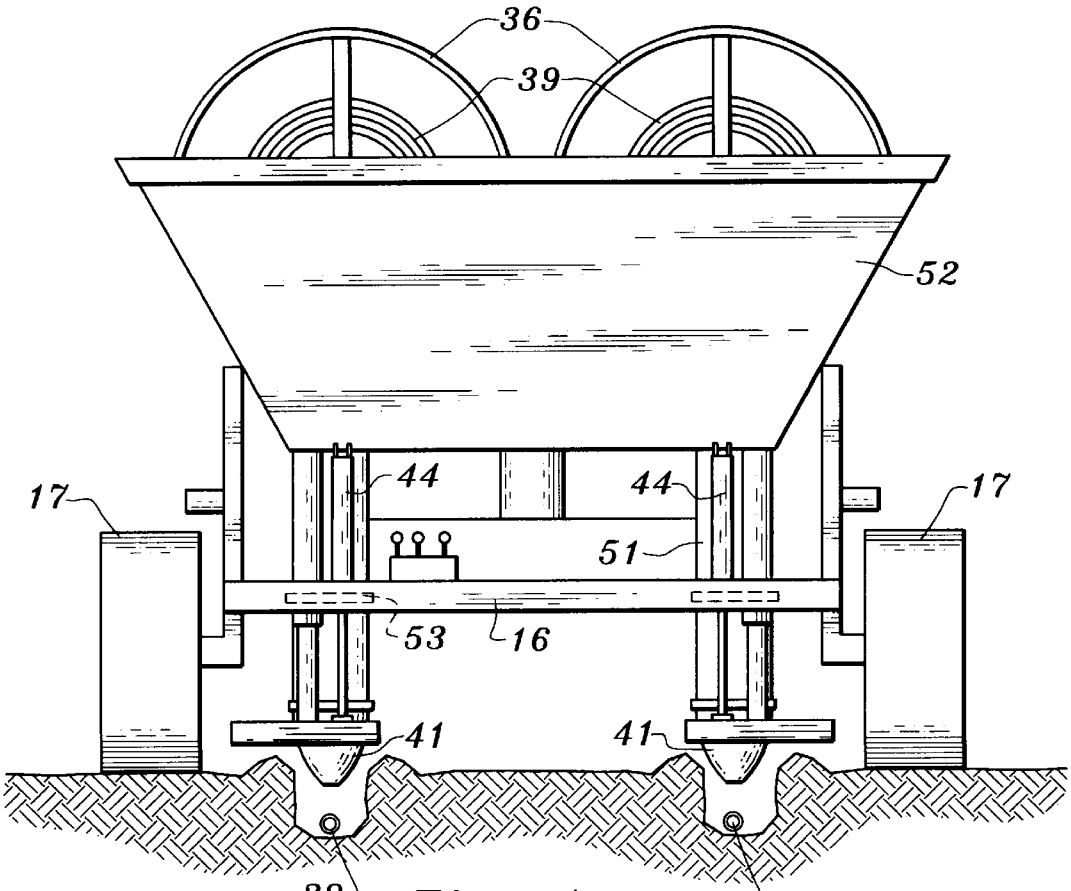
FIG. 4, is a rear perspective view of the sand or gravel hopper and funnel, according to the invention.

As seen in FIGS. 1 and 4, hopper 52 is preferably funnel shaped and about 5 feet tall and 7 feet wide by 4 feet long at its opening and funnels down to about 4 feet wide and 8 inches long. Of course any size sand hopper 52 may be used depending upon the application and the amount of sand required for the particular application. Sand hopper 52 is preferably welded to frame 16 and positioned over wheels 17 Water jet or sand liquification means are provided by a hose attachment ball valve 54, for attachment to a garden hose and is supplied with a water meter 56 so that the user can control the water flow into sand hopper 52. A hose may be provided which is a length of steel having a 90 degree bow keeps the hose from crimping as apparatus 10 pulls the hose along. A small pipe 60 connects at ball valve 54 and passes through the side of sand hopper 52 and to the sides of the openings of connector 51, allowing water to be sprayed down into the rubber connector 51 as well as into sand hopper 52. This allows the sand or gravel in hopper 52 to be liquified and thereby forces it to flow into connector 51, and then through funnel 41 and into the channel.

In operation and use trenching and pipe laying apparatus 10 is very convenient, easy, reliable, and effective to use for trenching, such as sand channel and pipe channel trenching, and pipe laying. For example, in a preferred application, on a golf course, or sportsfield, or park, apparatus 10 is hooked to tractor 12 by hitch 14. Vertical cutting blades 22 and horizontal strip remover blade 21 precut the turf and cutting wheel 26 cuts a channel in the ground. Often, an installation matrix is desired where channels are made at a selected distance and parallel from one another without any pipe being laid. The sand channels with pipe laid in a perpendicular direction are spaced at a selected distance from one another. The matrix may be lain out so that pipe drains with the contour of the site and into a larger pipe at the lowest part of the drained area. Of course, any number of channels in whatever pattern desired may be made with the trenching and pipe laying apparatus 10, and pipe either uniformly or selectively laid in such channels. In such manner, the present invention provides a means to quickly, efficiently, and economically pre-cut turf strips, dig channels, lay pipe, and place wet or dry sand, gravel or other particulate in such channels in a controlled and effective manner.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A sand channel trenching and pipe laying apparatus for attachment to a motor driven vehicle, comprising:

a frame;

a turf precutter assembly, said turf precutter assembly includes a pair of cutting blades and a turf strip remover; the turf precutter assembly being hingedly secured to said frame;

channel excavation means for digging a channel, said channel excavation means being operably mounted to said frame;

pipe dispensing means for laying and positioning pipe in said channel, said pipe dispensing means being operably secured to a subframe mounted on a rearward portion of the frame;

a sand funnel for funneling and directing sand into said channel, said sand funnel being operably linked to a sand hopper mounted on said frame; and water jet means for wetting sand in said sand hopper, allowing for liquification of the sand in the sand hopper forcing the sand to flow through said sand funnel into the channel.

2. The sand channel trenching and pipe laying apparatus of claim 1, wherein said channel excavation means is a cutting wheel positionally controlled by a hydraulic ram.

3. The sand channel trenching and pipe laying apparatus of claim 1, wherein said channel excavation means is a chain driven by a toothed sprocket, said chain being positionally controlled by a hydraulic ram.

4. The sand channel trenching and pipe laying apparatus of claim 1, wherein said pipe dispensing means comprises a pipe reel operably linked to said hopper and a pipe dispenser mounted on said subframe.

5. The sand channel trenching and pipe laying apparatus of claim 1, wherein said water jet means comprises a hose attachment device with a water flow meter allowing for the control of water and the liquification of said sand within said sand hopper.

6. A trenching and pipe laying apparatus for mounting to a tractor, comprising:

an elongated frame including a pair of spaced apart sides and hitch means for connecting the trenching and pipe laying apparatus to said tractor;

turf cutting means for cutting and removing strips of turf, said turf cutting means being hingedly mounted to said elongated frame;

channel excavation means for digging a pipe channel, said channel excavation means being operably mounted to said elongated frame;

pipe dispensing means for dispensing and laying pipe in said pipe channel; said pipe dispensing means being mounted to a subframe secured to said elongated frame;

a sand hopper mounted to the elongated frame;

a sand funnel for funneling and directing sand into said pipe channel, said sand funnel being operably mounted on the subframe; and sand liquifying means for liquifying sand within said sand hopper, said sand liquifying means being operably mounted on the sand hopper.

7. The sand channel trenching and pipe laying apparatus of claim 6, wherein said channel excavation means is a cutting wheel positionally controlled by a hydraulic ram.

8. The sand channel trenching and pipe laying apparatus of claim 6, wherein said channel excavation means is a chain with digging teeth driven by a toothed sprocket, said chain being positionally controlled by a hydraulic ram.

9. The sand channel trenching and pipe laying apparatus of claim 6, wherein said pipe dispensing means comprises a pipe reel linked to said sand hopper and to a pipe dispenser mounted on said subframe operably linked to a hydraulic ram.

10. The sand channel trenching and pipe laying apparatus of claim 6, wherein said sand liquifying means comprises a hose attachment device with a water flow meter allowing for the control of water and the liquification of said sand within said sand hopper.

* * * * *